US008752395B2

(12) United States Patent
McCormick et al.

(10) Patent No.: US 8,752,395 B2
(45) Date of Patent: Jun. 17, 2014

(54) COMBUSTOR LINER SUPPORT AND SEAL ASSEMBLY

(75) Inventors: Kelly Jon McCormick, Indianapolis, IN (US); Michel Shawn Smallwood, Greenwood, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 80 days.

(21) Appl. No.: 13/016,146

(22) Filed: Jan. 28, 2011

(65) Prior Publication Data

US 2012/0192571 A1 Aug. 2, 2012

(51) Int. Cl.
*F02C 7/20* (2006.01)
*F02C 1/00* (2006.01)

(52) U.S. Cl.
USPC ..... 60/796; 60/752

(58) Field of Classification Search
USPC ..... 60/796, 752–760
See application file for complete search history.

(56) References Cited

U.S. PATENT DOCUMENTS

| | | | | |
|---|---|---|---|---|
| 4,361,296 | A | 11/1982 | Hall et al. | |
| 5,275,357 | A * | 1/1994 | Seelen et al. | 244/54 |
| 5,289,677 | A * | 3/1994 | Jarrell | 60/796 |
| 6,347,508 | B1 | 2/2002 | Smallwood et al. | |
| 6,658,853 | B2 * | 12/2003 | Matsuda et al. | 60/753 |
| 7,093,440 | B2 * | 8/2006 | Howell et al. | 60/752 |
| 7,140,185 | B2 * | 11/2006 | Burd | 60/752 |
| 7,900,461 | B2 * | 3/2011 | Varney et al. | 60/800 |
| 2004/0045298 | A1 * | 3/2004 | Pidcock et al. | 60/752 |
| 2009/0301093 | A1 * | 12/2009 | Martinez et al. | 60/752 |

FOREIGN PATENT DOCUMENTS

| | | |
|---|---|---|
| EP | 2 078 826 | 7/2000 |
| EP | 1 965 027 | 9/2008 |

OTHER PUBLICATIONS

Euorpean Search Report, EP 12 25 0017, Rolls-Royce Corporation, May 8, 2013.

* cited by examiner

*Primary Examiner* — Ehud Gartenberg
*Assistant Examiner* — Arun Goyal
(74) *Attorney, Agent, or Firm* — Krieg DeVault LLP

(57) ABSTRACT

A combination including a gas turbine engine extending along an axis is disclosed herein. The gas turbine engine includes an annular combustor having a combustor liner. The combination also includes a plurality of projections extending from the combustor liner and spaced from one another circumferentially about the axis. The combination also includes a free-standing ring disposed about the combustor liner and positioned adjacent to the plurality of projections along the axis. The plurality of projections engage the free-standing ring and circumferentially support the combustor liner while allowing relative radial displacement between the combustor liner and the free-standing ring. The combination also includes a plurality of pins each being integrally-formed with one of the plurality of projections. Each of the plurality of pins extends along the axis and is received in one of a plurality of slots formed in the free-standing ring.

21 Claims, 4 Drawing Sheets

COMBUSTOR LINER SUPPORT AND SEAL ASSEMBLY

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of N00019-04-C-0102 awarded by the Department of Defense.

BACKGROUND OF THE INVENTION

1. Field of the Invention

The invention relates generally to gas turbine engines. More particularly, the present invention relates to a structure for supporting a combustor liner in a gas turbine engine.

2. Description of Related Prior Art

U.S. Pat. No. 6,347,508 sets forth a combustor liner support and seal assembly. Applying the reference numerals used in the '508 patent, an outer combustor liner 28b is supported at its aft end 71 with an inner mounting ring 60 having a plurality of projections or lugs 74. An outer ring 62 includes first and second flanges 92, 94 disposed on opposite sides of the lugs 74. Pins 100 are welded in apertures 104 defined in the flange 94 and extend into slots 76 defined in the lugs 74. The cooperation between the pins 100 and the slots 76 allows the ring 62 and the lugs 74 to move radially with respect to another. Relative radial movement can be desirable because different thermal coefficients of expansion between the combustor liner 28b/mounting ring 60 and the outer ring 62 can lead to undesirable higher thermal gradients and stresses within the liner if the two parts are fixed to one another.

SUMMARY OF THE INVENTION

In summary, the invention is a combination including a gas turbine engine extending along an axis. The gas turbine engine includes an annular combustor having a combustor liner. The combination also includes a plurality of projections extending from the combustor liner and spaced from one another circumferentially about the axis. The combination also includes a free-standing ring disposed about the combustor liner and positioned adjacent to the plurality of projections along the axis. The plurality of projections engage the free-standing ring and circumferentially support the combustor liner while allowing relative radial displacement between the combustor liner and the free-standing ring. The combination also includes a plurality of pins each being integrally-formed with one of the plurality of projections. Each of the plurality of pins extends along the axis and is received in one of a plurality of slots formed in the free-standing ring.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF AN EXEMPLARY EMBODIMENT

The invention, as demonstrated by the exemplary embodiment described below, provides an enhanced combustor liner support and seal assembly. The pins are integrally-formed with the plurality of projections. This feature eliminates the need for separate pin components and thus reduces part count and assembly time. However, this feature also leads to at least two additional advantages in the exemplary embodiment as well as other embodiments. First, the integrally-formed pins and all the slots can be located on the aft facing, downstream side of the seal. This arrangement eliminates the need for any openings through the seal components for the purpose of "pin" retention or "pin travel" allowance which are potential air leak paths that can vary in size and shape depending on the temperature differences between various components on opposite sides of the aft seal. As a result, the exemplary embodiment of the invention provides a consistently lower air leakage potential. The area of contact among the sealing components can be maximized. A second advantage of forming the pins to be integral with the projections is that the radial height of the projections can be minimized. The pins can be disposed at substantially the radially-outermost edge of the projections. The slots, formed on the free-standing ring, are sized relatively larger to accommodate the range of movement. This reduces the moment of inertia of the liner support defining the projections compared to designs wherein the slots are formed in the projections. This shortening of the projections allows the maximum diameter of the outer combustor liner's aft seal assembly to be reduced, eliminating material and therefore reducing weight.

Figure 1:
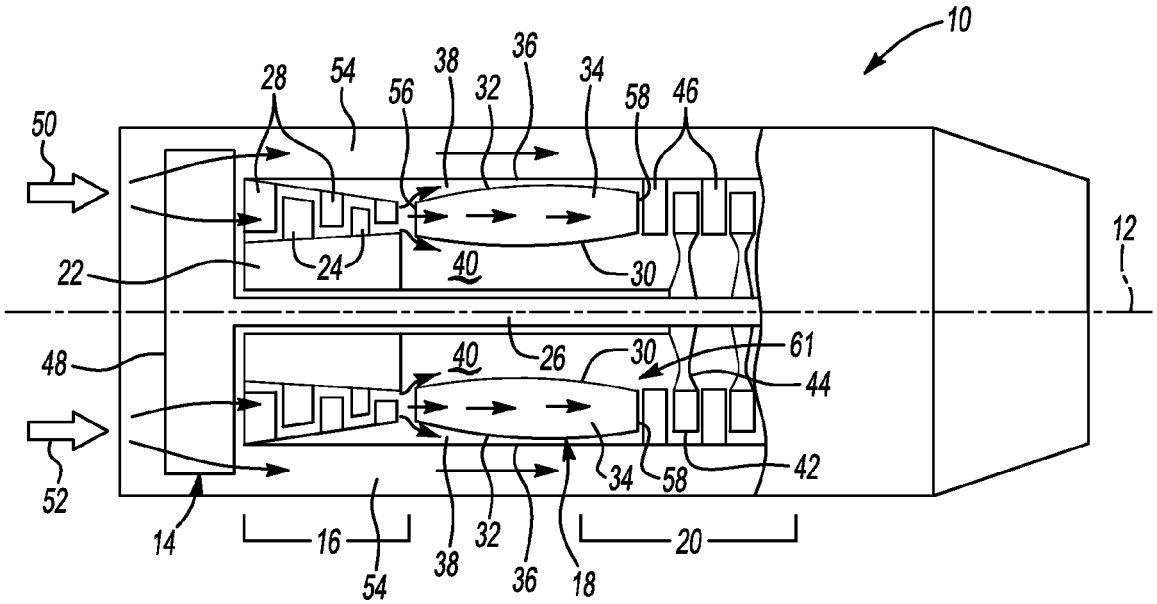
FIG. 1 is a simplified schematic view of a gas turbine engine according to the exemplary embodiment of the invention.

FIG. 1 is a schematic representation of a gas turbine engine 10. The gas turbine engine 10 extends along a longitudinal axis 12. As used herein, forms of the terms "radial" and "circumference" as applied to some structure refer to the relationship between the structure and the axis 12. The gas turbine engine 10 has a generally annular configuration, however other configurations can be practiced in alternative embodiments of the present invention. The exemplary gas turbine engine 10 includes a fan section 14, a compressor section 16, a combustor section 18, and a turbine section 20 that are integrated to produce an aircraft flight propulsion engine. This particular type of gas turbine engine is generally referred to as a turbo-fan. An alternate form of a gas turbine engine that can be practiced with the invention includes a compressor, a combustor, and a turbine integrated to produce an aircraft flight propulsion engine without a fan section. It should be understood that the term aircraft is generic, including without limitation helicopters, airplanes, missiles, space devices and other substantially similar devices. It is also noted that numerous configurations of turbine engines can practiced with the invention. For example, multiple compressor and turbine sections can be incorporated, with intercoolers connected between the compressor stages. Also, reheat combustion chambers can be added between the turbine stages. All of the various configurations of gas turbine engines described above and/or known in the art can be practiced with the invention. It is also noted that the present invention can be practiced in operating environments other than aircraft propulsion, such as industrial applications including but not limited to pumping sets for gas and oil transmission lines, electricity generation, and naval propulsion.

The compressor section 16 includes a rotor 22 having a plurality of compressor blades 24. The rotor 22 is fixed to a rotatable shaft 26. A plurality of compressor vanes 28 are positioned adjacent to the compressor blades 24 to direct the flow of air through compressor section 16. The combustor section 18 includes an inner combustor liner 30 and an outer combustor liner 32. The liners 30, 32 cooperate with one another to define the inner and outer boundaries of an annular combustion chamber 34. The outer combustor liner 32 is concentrically mounted relative to an outer casing or housing 36 to define an annular fluid passage 38 that surrounds the chamber 34. Also, the inner combustor liner 30 is concentrically mounted relative to the shaft 26 to define an annular fluid passage 40 surrounded by the chamber 34. Fuel is introduced into combustion chamber 34 via a plurality of fuel nozzles (not shown). The inner and outer liners 30, 32 are each formed of materials that are capable of withstanding high temperature environments. Materials such as metallic superalloys and inter-metallic materials, and structures such as Lamilloy®, are contemplated as being within the scope of embodiments of the invention.

The turbine section 20 includes a plurality of turbine blades 42, each coupled to a rotor disk 44. The rotor disk 44 is fixed to the shaft 26. A plurality of turbine vanes 46 are positioned adjacent to the turbine blades 42 to direct the flow of the hot gaseous fluid stream through the turbine section 20. A turbine nozzle 61, sometimes referred to as the first row of turbine vanes 46 or the "inlet guide" turbine vanes, is positioned downstream of the combustor section 18 to direct the hot gaseous fluid stream exiting the combustion chamber 34 toward the turbine blades 42. In the exemplary embodiment of the invention, the gaseous fluid comprises combustion gases.

In operation, the turbine section 20 provides rotational power to one or more shafts 26 to drive the fan section 14 and the compressor section 16, respectively. The fan section 14 includes a fan 48. Air enters the gas turbine engine 10 in the direction indicated by arrows 50, 52 and passes through the fan section 14. The air stream is then divided and fed into both the compressor section 16 and a bypass duct 54. The compressed air exiting compressor section 16 is routed into both the combustion chamber 34 and also the annular fluid passages 38, 40. The compressed air enters the combustion chamber 34 at a forward end 56 of the combustor section 18 and is intermixed with fuel, to becoming a combustible air/fuel mixture. The air/fuel mixture is ignited and burned in the combustor section 18, generating a hot gaseous fluid stream. The hot gaseous fluid stream exits an aft end 58 of the combustor section 18 and is fed into the turbine section 20 to provide the energy applied to power the gas turbine engine 10. During normal operation of the gas turbine engine 10, the air flowing through passages 38, 40 is at a higher pressure than the hot gaseous air stream flowing through combustion chamber 34 and is also at a lower temperature.

Two operational considerations relating to the turbine nozzle follow from the arrangement described above. First, the combustor liners 30, 32 move relative to the turbine section 20 and nozzle 61 and it is thus desirable to seal fluid passageways 38, 40 from the turbine blades 42 and turbine vanes 46. Second, the pressure differential between the fluid streams moving around the outside of the combustion chamber 34 in the passage 38 and the hot gaseous fluid stream moving inside the combustion chamber 34 results in a buckling load on the combustor liner 32 and it is therefore desirable to support the floating ends of the combustor liner 32 against inward deflection.

Figure 2:
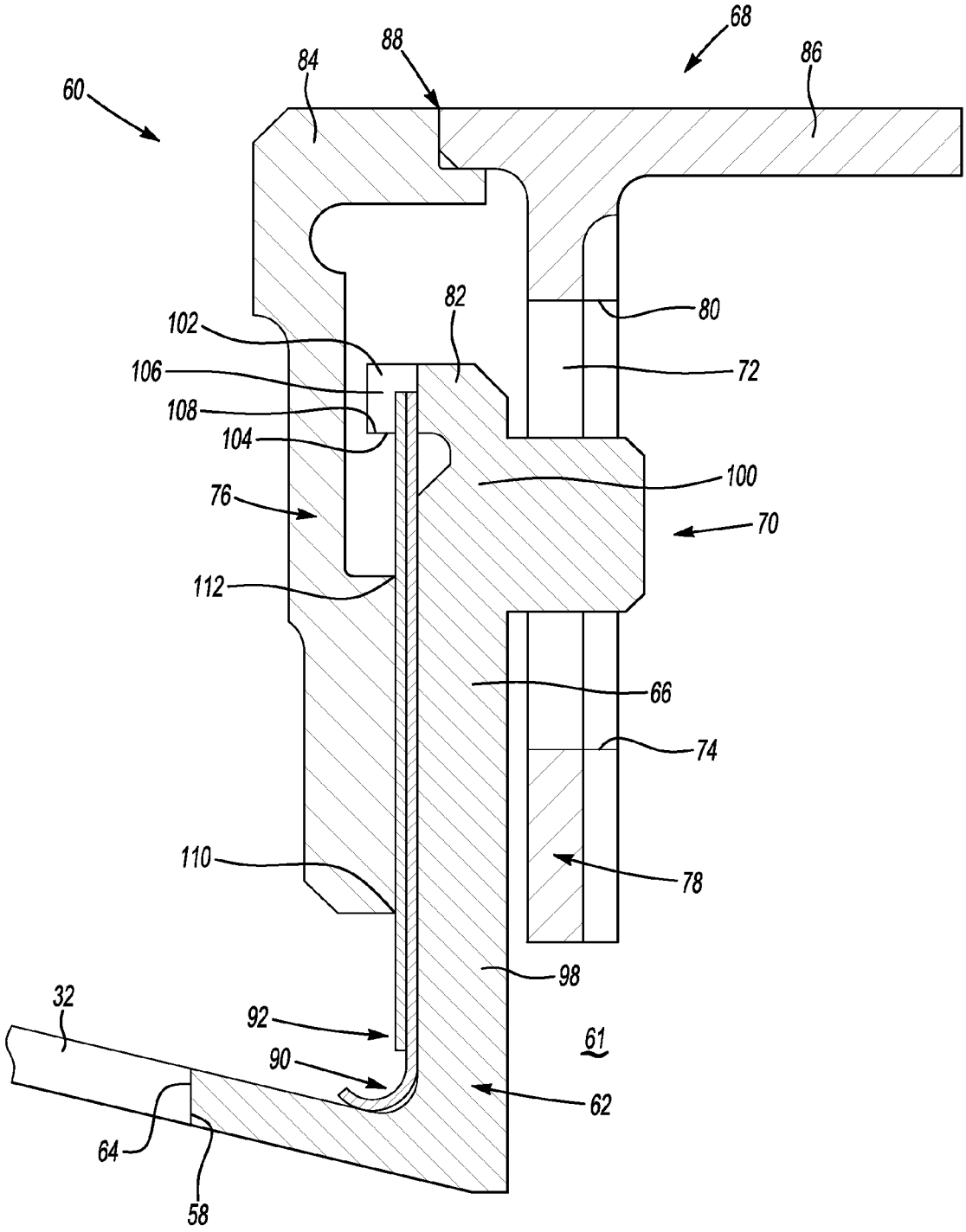
FIG. 2 is a cross-sectional view of an exemplary embodiment of the invention.
Figure 3:
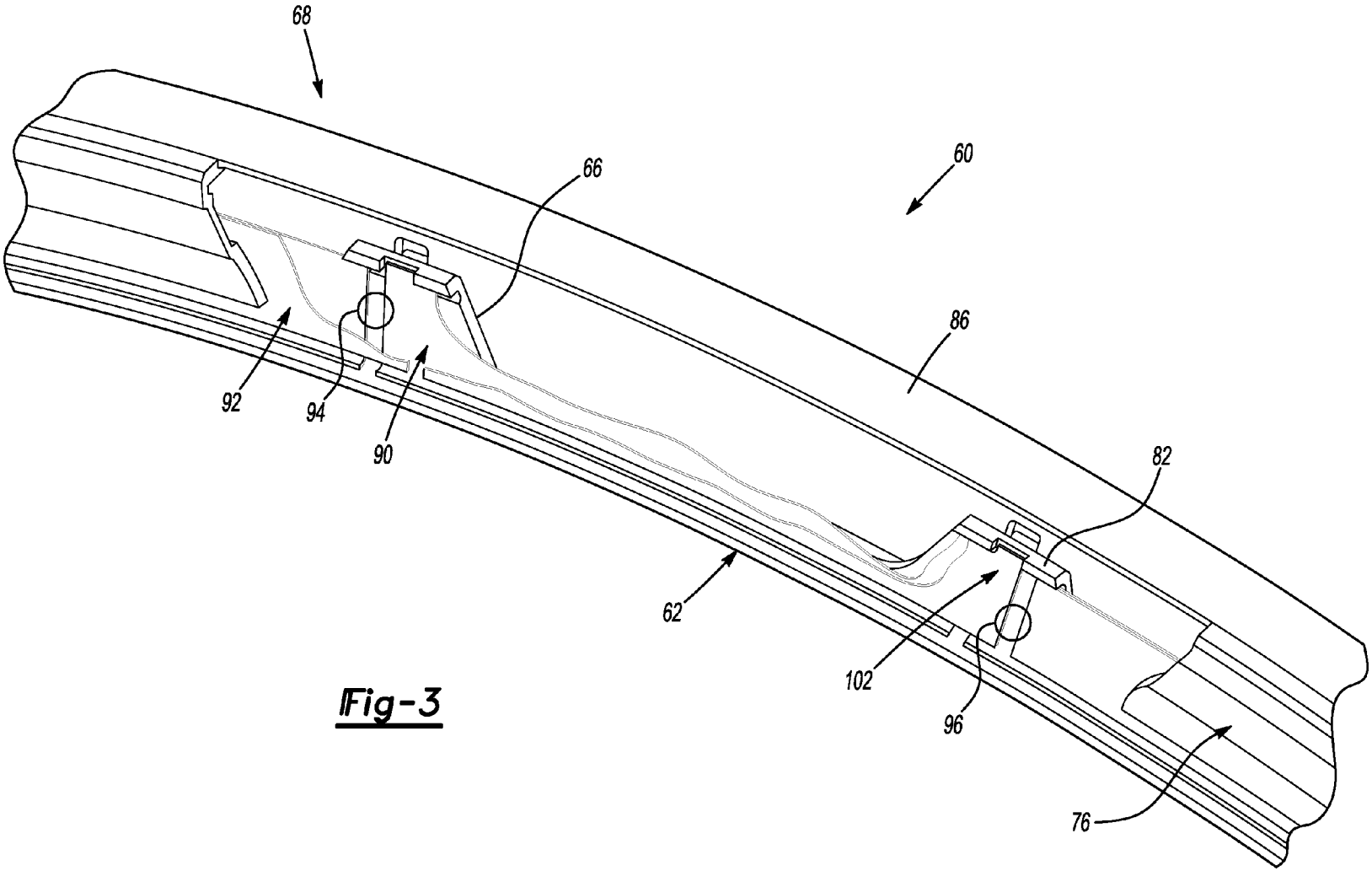
FIG. 3 is a perspective view looking generally aft of a plurality of projections according to the exemplary embodiment of the invention and a portion of a free-standing ring according to the exemplary embodiment of the invention, with portions of some structures cut-away to enhance the viewing of other structures.
Figure 4:
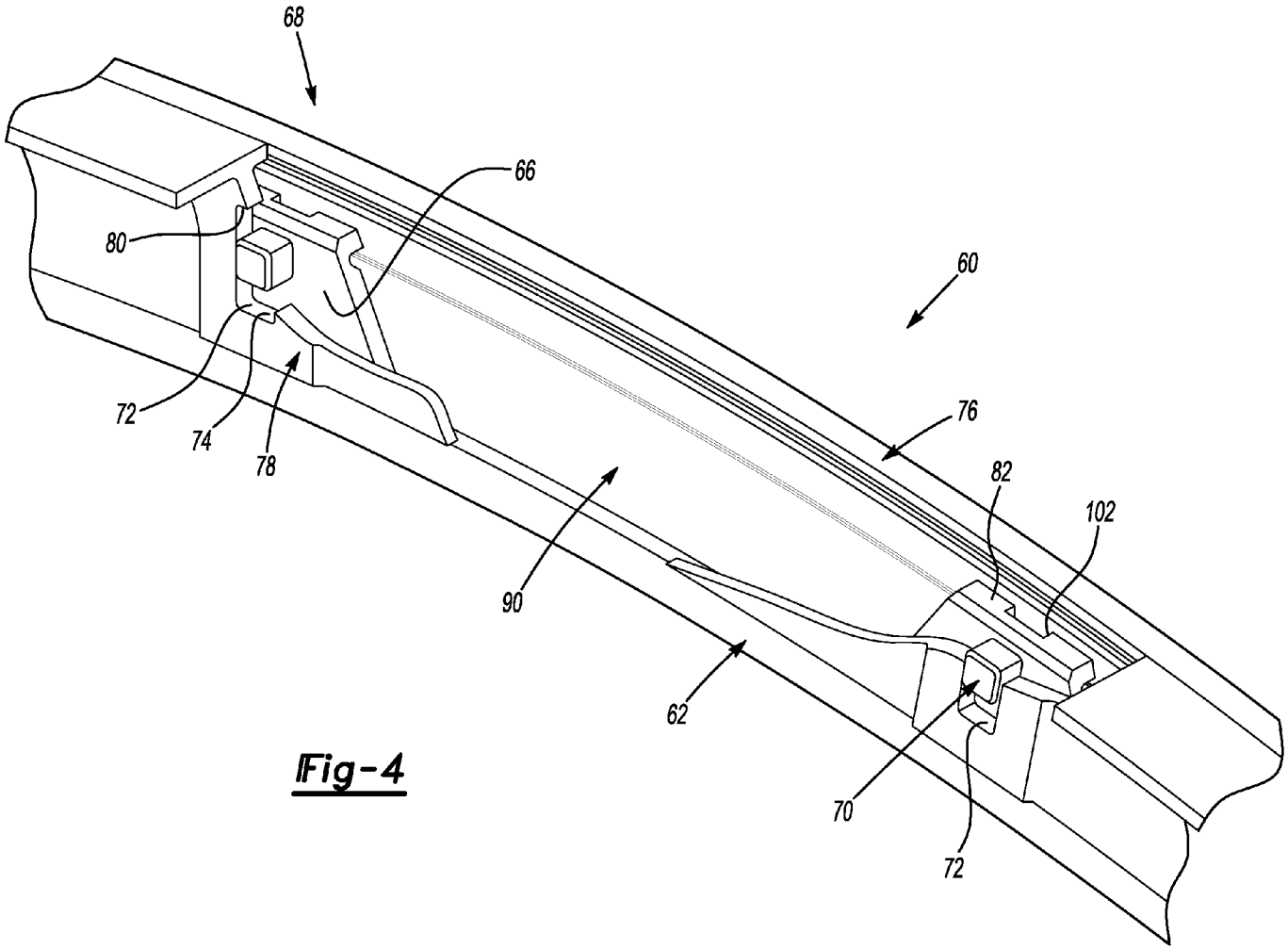
FIG. 4 is a perspective view looking generally forward of the plurality of projections and a portion a free-standing ring, with a portion of the free-standing ring cut-away.

Referring now to FIG. 2-4, a combustor liner support and seal assembly 60 is positioned between the aft end 58 of the combustor liner 32 and adjacent to the turbine nozzle 61. The aft end 58 of liner 32 is spaced from the turbine nozzle 61, defining a passageway. The assembly 60 closes and seals this passageway while allowing the aft end 58 to expand and contract radially. The assembly 60 also supports the liner 32 and helps prevent buckling. An inner support ring 62 includes a forward end 64 fixed to the aft end 58 of the combustor liner 32 about the entire periphery of the outer combustor liner 32, such as by welding. A plurality of tangs or projections 66 extend from the combustor liner 32 by way of the inner support ring 62. The projections 66 are spaced from one another circumferentially about the axis 12. The assembly 60 also includes a free-standing ring 68 disposed about the combustor liner 32 and positioned adjacent to the plurality of projection 66 along the axis 12. The combustor liner 32 (including the inner support ring 62) can float relative to the free-standing ring 68 in a plane normal to the axis 12. The plurality of projections 66 circumferentially support the combustor liner 32, by forming a cross-key arrangement, while allowing relative radial displacement between said combustor liner 32 and said free-standing ring 68. Interaction between the projections 66 and slots 72 (discussed in greater detail below) reduce the likelihood of buckling the combustor liner 32.

The exemplary combustor liner 32 is formed of a metallic material and has a thermal mass less than the thermal mass of the ring 68. Also, the combustor liner 32 has a coefficient of thermal expansion that is equal to the coefficient of thermal expansion of the ring 68 and the ring 68 has a higher moment of inertia than the liner 32 and inner support ring 62. As a result, during operation the combustion liner 32 and the inner support ring 62 will radially expand and contract together in response to the thermal cycle operation of the gas turbine engine 10 at a relatively greater rate and the free-standing ring 68 will radially expand and contract at a relatively slower rate. To compensate for this variation in radial expansion and contraction, relative radial displacement between the inner support ring 62 and the free-standing ring 68 is permitted. The radial movement of the inner support ring 62 and the liner 32 reduces undesirable hoop and bending stresses from developing within the liner 32 which might otherwise result in low cycle fatigue (LCF) and the eventual failure of the liner 32.

A pin 70 is integrally-formed with each of the plurality of projections 66. Each of the plurality of pins 70 extends along the axis and is received in one of a plurality of slots 72 formed in the free-standing ring 68. "Integrally-formed" refers to the fact that the pin 70 and the projection 66 are formed together, at the same time. The pin 70 and projection 66 are not individually formed and subsequently joined such as with adhesive, welding, or a fastener.

The exemplary free-standing ring 68 includes a first radially-extending flange 76 disposed on a first side of the plurality of projections 66 along the axis 12 and a second radially-extending flange 78 disposed on a second side of the plurality of projections 66 along the axis 12 opposite the first side. The flange 76 can extend radially-inward from a ring portion 84 and the flange 78 can extend radially-inward from a ring portion 86. The ring portions 84, 86 can be welded together along an annular weld joint 88. The pins 70 extending away in an aft direction from an aft axial side of the plurality of projections 66. The plurality of exemplary slots 72 are thus formed only in the second radially-extending flange 78.

The slots 72 extend radially-outward from a first closed end 74 to a second closed end 80 spaced radially outward of the first closed end 74. The pins 70 are limited in radial movement by the first and second ends 74, 80 of the slot 72, thereby limiting the relative radial displacement between the liner 32 and the free-standing ring 68. Limiting radial relative movement through the closed slots 72 ensures that the pins 70 will not pass out of the slots 72 and also prevents deformation of the liner 32 and the inner support ring 62, caused by a thermal growth differential, beyond a range deemed acceptable. Similarly, the engagement of the pins 70 within slots 72 nearly maintains coaxiality of the free-standing ring 68 and the inner support ring 62, by way of a cross-key arrangement. The length of slot 72 between the closed ends 74, 80 can be selected so that the outer closed end 80 is not engaged by a pin 70 during expected thermal growth in order to maximize low-cycle fatigue life. The liner 32 could buckle if a predetermined amount of expansion is prevented. The length of the slot 72 between the first and second ends 74, 80 defines the predetermined amount of design travel.

The liner wall 32, and the attached support ring 62, are thin walled and relatively flimsy (radially) due to a thin radial cross section. These structures have a low "bending" moment of inertia. The outer support ring portions 84 and 86 have a comparatively wide radial cross section giving them a higher resistance to radial deformation (a relatively high "bending" moment of inertia). Coupling these structures via the pins 70 and the slots 72 limits the amount of possible radial deformation of the support ring 62, effectively imparting the higher moment of inertia of the ring portions 84 and 86 to the relatively flimsy support ring 62 providing increased buckling resistance.

On the thermal side, the liner 32 and support ring 62 are subjected to a relatively high range of temperatures and the liner 32 in particular reacts quickly (dimensionally) to changes in thermal input (the liner 32 has a relatively low thermal inertia). The outer support ring portions 84 and 86, on the other hand, are outside the combustion region and do not see such drastic temperature changes. Additionally, due to greater thermal mass and reduced exposure to cooling air and combustion gases, the outer support ring portions 84 and 86 react much more slowly dimensionally (the ring portions 84 and 86 thus have a relatively high thermal inertia).

The "cross-key" arrangement discussed above is discussed more thoroughly in U.S. Pat. No. 6,347,508, particularly at column 8, lines 13-65. The '508 patent is hereby incorporated by reference to the present application. The cross-key arrangement refers to the varying the orientation of the slots about axis 12. Each slot 72 extends radially outward from the centerline axis 12 and thus each slot 72 extends transverse to every other slot 72 (except possibly a slot 72 on the exact opposite side of the centerline axis 12). The cross-key feature serves to fix the relative circumferential orientation of the support ring portions 84 and 86 as well as maintaining the position of ring portions 84 and 86 roughly centered on the support ring 62 at all times. The "peripheral" support mentioned in the '508 patent refers to a less obvious benefit of the cross-key arrangement. If the support ring 62 deforms radially inward or outward between adjacent tangs/projections 66, where the moment of inertia is lower, the pins 70 eventually come in to contact with the side walls of their respective slots 72. This provides buckling resistance regardless of the radial position of the pin 70 in the slot 72 (not bottomed or topped out in the slot).

It can be desirable to position the pins 70 such that the pins project from a radially-outermost point of the projections 66. By so positioning the pins 70, the maximum diameter of the inner support ring 62, including the projections 66, can be minimized. As a result, the weight of the inner support ring 62 can be minimized. In the exemplary embodiment, the pins 70 project from a distal end 100 of the projections 66, offset from the radially-outermost point of the projections 66 a minimal distance to accommodate a flange 82 formed on the forward side of the projections 66.

The cross-section of the pins 70 can be substantially rectangular, such as a square or a rectangle. This shape maximizes the area of contact between the pin 70 and the slot 72. Substantially rectangular refers to the fact that the cross-section can have rounded corners, but otherwise be rectangular. The cross-section of the pins can be different in other embodiments of the invention.

The exemplary embodiment of the invention also includes a plurality of leaf seals arranged about the inner support ring 62 of the combustor liner 32. A first layer of leaf seals, such as leaf seal 90, abuts or contacts the plurality of projections 66. A second layer of leaf seals, such as leaf seal 92, abuts or contacts the first layer of leaf seals 90 and is spaced from the plurality of projections 66 along the axis 12. Each of the exemplary layers of leaf seals 90, 92 are formed with a plurality of individual leaf seals placed in adjoining, side-by-side relationship to one another to define a substantially continuous sealing surface extending circumferentially around the axis 12. Further, the exemplary layers of leaf seals 90, 92 are circumferentially staggered. At locations where two leaf seals 90 circumferentially confront one another (referenced at 94 in FIG. 3), a single leaf seal 92 overlaps this area. Similarly, at locations where two leaf seals 92 circumferentially confront one another (referenced at 96 in FIG. 3), a single leaf seal 90 overlaps this area.

As best shown in FIG. 2, each of the exemplary projections 66 extends from a base 98 to the distal end 100 and includes the flange 82 projecting along the axis 12 from the distal end 100. A notch 102 extends through each of the flanges 82. The exemplary notches 102 and the pins 70 are thus disposed on opposite sides of the projections 66. The notch 102 can extend at least partially in a radial direction relative to the axis. The exemplary notches 102 can extend perpendicular (a fully radial direction) to the axis 12. At least part of each of the leaf seals 90, 92 is received in one of the notches 102 for limiting circumferential movement of the plurality of leaf seals 90, 92 relative to the plurality of projections 66. The first and second layers of leaf seals 90, 92 engage alternating and opposite projections 66. In other words, the leaves of the first layer 90 engage every other projection 66 and the leaves of the second layer 92 engage the projections 66 not engaged by the leaves of the first layer 90. This is best shown in FIG. 3.

The projections 66 are thus formed to define a recessed portion for receiving at least part of a seal, the exemplary seal being the layers 90, 92 of the leaf seals. The exemplary recessed portion is bound in part by a first wall 104 being arcuate and extending circumferentially about the axis 12. The exemplary recessed portion is also bound by a second wall 106 extending radially relative to the axis 12. The exemplary second wall 106 is part of the notch 102. A shoulder 108 is defined at a junction of the first and second walls 104, 106.

As set forth above, the exemplary free-standing ring 68 includes a first radially-extending flange 76 disposed on a forward side of the plurality of projections 66 along the axis 12 and a second radially-extending flange 78 disposed on an aft side of the plurality of projections 66 along the axis 12. The exemplary first radially-extending flange 76 is circumferential and radially continuous about the axis. In other words, the first radially-extending flange 76 is not punctured or pierced, such as by a guide pin or slot. There are no potential leakage pathways through the exemplary first radially-extending flange 76.

As best seen in FIG. 2, the exemplary first radially-extending flange 76 and the plurality of leaf seals 92 contact one another at a radially-innermost edge 110 and at a radially-outermost edge 112. In the exemplary embodiment, contact between the first radially-extending flange 76 and the plurality of leaf seals 92 is radially continuous between the radially-innermost edge 110 and the radially-outermost edge 112. Neither a guide pin nor a slot interrupt the contact between the first radially-extending flange 76 and the plurality of leaf seals 92 between the radially-innermost edge 110 and the radially-outermost edge 112. The contact between the first radially-extending flange 76 and the plurality of leaf seals 92 is circumferentially substantially continuous about the axis 12. The only circumferential gaps being defined at locations 96 and the size of these gaps can be minimized.

The exemplary embodiment of the invention has been applied to the radially-outer half 32 of the combustor liner 18. However, alternative embodiments of the invention can be practiced wherein the radially-inner half 30 of the combustor liner 18 is assembled to include projections like projections 66, only projecting radially inward, and pins integrally-formed with these projections. Since the inner combustor liner 30 is typically not subject to buckling loads of the magnitude existing across the outer liner 32, mechanical buckling is not as prevalent. In this case, the interaction between the pins 70 and the slots 72 serves more as a cross-key arrangement for maintaining proper alignment and positioning of the inner liner 30 relative to outer support ring 68. Also, the combustor liner support and seal assembly 60 provides additional circumferential support to the inner liner 30, thus allowing the inner liner 30 to be fabricated from thinner material than would otherwise be possible.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Further, the "invention" as that term is used in this document is what is claimed in the claims of this document. The right to claim elements and/or sub-combinations that are disclosed herein as other inventions in other patent documents is hereby unconditionally reserved.

What is claimed is:

1. A combination comprising:

a gas turbine engine extending along an axis and including an annular combustor having a combustor liner;

a plurality of projections extending from said combustor liner and spaced from one another circumferentially about said axis, wherein each of said plurality of projections extends from a base to a distal end and includes a flange projecting along said axis from the distal end, wherein a notch cutout extends through each of said flanges from the plurality of projections along said axis in an at least partially radial direction relative to said axis, and wherein said flange includes a radially inward facing surface;

a free-standing ring disposed about said combustor liner and positioned adjacent to said plurality of projections along said axis, wherein said free-standing ring includes a plurality of slots formed therein;

a leaf seal having a radially outer surface; and a plurality of pins, each pin being integrally formed with one of said plurality of projections and extending along said axis, wherein each of said plurality of pins is received into one of said plurality of slots, wherein said plurality of pins engage said free-standing ring via said plurality of slots, and wherein said plurality of pins and said plurality of slots are positioned to circumferentially support said combustor liner by virtue of the engagement of the plurality of pins with the plurality of slots while allowing relative radial displacement between said combustor liner and said free-standing ring;

wherein said radially inward facing surface is positioned to radially constrain the leaf seal against outward radial movement via the radially outer surface and said notch is positioned to constrain the leaf seal against circumferential movement; and wherein the leaf seal does not include an opening therein.

2. The combination of claim 1 wherein each of said plurality of pins are further defined as extending away from only one axial side of said plurality of projections.

3. The combination of claim 2 wherein each of said plurality of pins are further defined as extending away in an aft direction from an aft axial side of said plurality of projections.

4. The combination of claim 1 wherein said notches and said pins are disposed on opposite sides of said projections.

5. The combination of claim 1 further comprising:

a plurality of leaf seals arranged about said combustor liner and abutting said plurality of projections, at least part of each of said leaf seals received in one of said notches for limiting circumferential movement of said plurality of leaf seals relative to said plurality of projections.

6. The combination of claim 5 wherein said plurality of leaf seals further comprises:

a first layer of leaf seals abutting said plurality of projections; and a second layer of leaf seals abutting said first layer of leaf seals and spaced from said plurality of projections along said axis, wherein said first and second layers of leaf seals engage alternating and opposite projections.

7. The combination of claim 1 wherein said free-standing ring further comprises:

a first radially-extending flange disposed on a first side of said plurality of projections along said axis; and a second radially-extending flange disposed on a second side of said plurality of projections along said axis opposite said first side, wherein said plurality of slots are formed only in one of said first and second radially-extending flanges.

8. The combination of claim 7 further comprising:

a plurality of leaf seals arranged circumferentially about said combustor liner between said plurality of projections and said first radially-extending flange, said first radially-extending flange and said plurality of leaf seals contacting one another at a radially-innermost edge and at a radially-outermost edge, wherein contact between said first radially-extending flange and said plurality of leaf seals is radially continuous between said radially-innermost edge and said radially-outermost edge.

9. The combination of claim 8 wherein contact between said first radially-extending flange and said plurality of leaf seals is circumferentially substantially continuous about said axis.

10. The gas turbine engine of claim 1, wherein each pin includes opposing flat surfaces, wherein said plurality of pins are received into and engage said plurality of slots with said opposing flat surfaces to support said combustor liner by virtue of the engagement of the opposing flat surfaces of the plurality of pins with the plurality of slots while allowing relative radial displacement between said combustor liner and said free-standing ring.

11. A method comprising the steps of:

extending a gas turbine engine including an annular combustor having a combustor liner along an axis;

extending a plurality of projections spaced from one another circumferentially about the axis radially outward from the combustor liner, wherein each of said plurality of projections extends from a base to a distal end and includes a flange projecting along said axis from the distal end, wherein a notch cutout extends through each of said flanges from the plurality of projections along said axis in an at least partially radial direction relative to said axis, and wherein said flange includes a radially inward facing surface;

extending a plurality of pins along the axis from the plurality of projections, wherein each pin is formed integrally with one of said plurality of projections;

disposing a free-standing ring about the combustor liner adjacent to the plurality of projections along the axis, wherein the free-standing ring includes a plurality of slots formed therein;

positioning the plurality of slots and the plurality of pins to circumferentially support the combustor liner;

engaging the plurality of slots of the free-standing ring with the plurality of projections pins;

providing a leaf seal having a radially outer surface, wherein the leaf seal does not include an opening therein;

radially constraining the leaf seal using the radially inward facing surface against the radially outer surface;

positioning the notch to constrain the leaf seal against circumferential movement;

radially constraining the leaf seal against circumferential movement; and circumferentially supporting the combustor liner with the plurality of pins by virtue of the engagement of the plurality of pins with the plurality of slots while allowing relative radial displacement between the combustor liner and the free-standing ring.

12. The method of claim 11 further comprising the step of:

forming the projection to define a recessed portion for receiving a seal, the recessed portion bound at least in part by a first wall being arcuate and extending circumferentially about the axis and by a second wall extending radially relative to the axis with at least one shoulder defined at a junction of the first and second walls.

13. The method of claim 11 further comprising the steps of:

disposing the plurality of projections between first and second radially-extending flanges of the free standing ring; and positioning the pins in slots formed by only by the first radially-extending flange.

14. The method of claim 13 further comprising the step of:

forming a seal between the second radially-extending flange and the plurality of projections wherein the seal is continuous both circumferentially and radially relative to the axis.

15. The method of claim 11 further comprising the step of:

projecting each of the plurality pins from respective distal ends of the plurality of projections.

16. A gas turbine engine comprising:

an annular combustor extending along an axis of said gas turbine engine, and having a combustor liner extending along said axis;

a plurality of projections extending from said combustor liner and evenly spaced from one another circumferentially about said axis, wherein each of said plurality of projections extends from a base to a distal end and includes a flange projecting along said axis from the distal end, wherein a notch cutout extends through each of said flanges from the plurality of projections along said axis in an at least partially radial direction relative to said axis, and wherein said flange includes a radially inward facing surface;

a plurality of pins extending from the plurality of projections, wherein each pin includes first opposing flat surfaces;

a free-standing ring disposed about said combustor liner and positioned adjacent to said plurality of projections along said axis and having a plurality of slots, wherein each slot has second opposing flat surfaces positioned to engage the first opposing flat surfaces; and a leaf seal having a radially outer surface, wherein the leaf seal does not include an opening therein, wherein said first opposing flat surfaces are received into and engage said second opposing flat surfaces, and wherein said first opposing flat surfaces and said second opposing flat surfaces are positioned to form a cross-key arrangement that supports said combustor liner by virtue of the engagement of the first opposing flat surfaces with the second opposing flat surfaces while allowing relative radial displacement between said combustor liner and said free-standing ring; and wherein said radially inward facing surface is positioned to radially constrain the leaf seal against outward radial movement via the radially outer surface and said notch is positioned to constrain the leaf seal against circumferential movement.

17. The gas turbine engine of claim 16 wherein a cross-section of at least one of said pins is substantially rectangular.

18. The gas turbine engine of claim 16 wherein said free-standing ring further comprises:

a first radially-extending flange disposed on a forward side of said plurality of projections along said axis; and a second radially-extending flange disposed on an aft side of said plurality of projections along said axis, wherein said plurality of slots are formed only in said second radially-extending flange and said first radially-extending flange is circumferential and radially continuous about said axis.

19. The gas turbine engine of claim 18 further comprising:

first and second layers of leaf seals arranged circumferentially about said combustor liner between said plurality of projections and said free-standing ring, said free-standing ring and said second layer of leaf seals contacting one another at a radially-innermost edge and-at a radially-outermost edge, wherein contact between said first radially-extending flange and said second layer of leaf seals is fully continuous between said radially-innermost edge and said radially-outermost edge and substantially continuous circumferentially about said axis.

20. The gas turbine engine of claim 19 wherein said combustor liner further comprises:

a radially-outer liner half;

a radially-inner liner half encircled by said radially-outer liner half, a combustion chamber defined between said radially-outer liner half and said radially-inner liner half, wherein said plurality of projections extend from at least one of said radially-outer liner half and said radially-inner liner half.

21. A gas turbine engine comprising:

a combustor liner extending along an axis of the gas turbine engine, wherein said combustor liner includes a plurality of projections extending radially from said combustor liner substantially perpendicular to said axis, wherein said combustor liner includes a plurality of pins extending from said projections in a direction along said axis; wherein at least one pin extends from each projection; and wherein each pin includes first opposing flat surfaces, each flat surface extending in a plane approximately perpendicular to a circumferential direction about said axis, wherein each of said plurality of projections extends from a base to a distal end and includes a flange projecting along said axis from the distal end, wherein a notch cutout extends through each of said flanges from the plurality of projections along said axis in an at least partially radial direction relative to said axis, and wherein said flange includes a radially inward facing surface;

a leaf seal having a radially outer surface, wherein the leaf seal does not include an opening therein; and a free-standing ring disposed about said combustor liner and positioned adjacent to said plurality of projections along said axis, wherein said freestanding ring includes a plurality of radially-extending slots in positional correspondence with said plurality of pins, each slot including second opposing flat surfaces;

wherein said plurality of pins are received into and engage said plurality of slots, and wherein said first opposing flat surfaces and said second opposing flat surfaces are positioned to form a cross-key arrangement that supports said combustor liner and allows relative radial displacement between said combustor liner and said free-standing ring; and wherein said radially inward facing surface is positioned to radially constrain the leaf seal against outward radial movement via the radially outer surface and said notch is positioned to constrain the leaf seal against circumferential movement.

* * * * *